United States Patent [19]

Schrader et al.

[11] 4,392,309

[45] Jul. 12, 1983

[54] APPARATUS FOR HEAT TREATING A CONTINUOUSLY MOVING WEB

[75] Inventors: Alfons Schrader, Remscheid-Lennep; Waldemar Schreiner, Winsen, both of Fed. Rep. of Germany

[73] Assignee: Babcock Textilmaschinen GmbH, Seevetal, Fed. Rep. of Germany

[21] Appl. No.: 301,974

[22] Filed: Sep. 14, 1981

[30] Foreign Application Priority Data

Sep. 29, 1980 [DE] Fed. Rep. of Germany ..... 3036669

[51] Int. Cl.[3] ..... F26B 13/06

[52] U.S. Cl. ..... 34/54; 34/155; 34/160; 34/162; 34/159

[58] Field of Search ..... 34/155, 160, 156, 162, 34/159, 54; 68/5 C, 5 D, 5 E, 20; 432/143, 144, 145; 239/556, 568

[56] References Cited

U.S. PATENT DOCUMENTS 3,371,427 3/1968 Thygeson, Sr. ..... 34/155

4,154,005 5/1979 Pickering et al. ..... 34/155

4,219,942 9/1980 Coliva ..... 34/155

FOREIGN PATENT DOCUMENTS 2810178 9/1979 Fed. Rep. of Germany .

*Primary Examiner*—Larry I. Schwartz

*Attorney, Agent, or Firm*—Michael J. Striker

[57] ABSTRACT

A heat-treatment apparatus for a textile web comprises a gas-pervious conveyor belt having a stretch defining a treatment path having an upstream end and a downstream end, a system for feeding the web to the upstream end and for advancing the belt to advance the web toward said downstream end along the path, a plurality of upwardly directed lower slot nozzles underneath the stretch along said path, a plurality of downwardly directed upper slot nozzles above the stretch along the path and a device for feeding a hot gas alternately to the upper and lower nozzles. The lower slot nozzles are transverse to at least some of the upper slot nozzles.

8 Claims, 8 Drawing Figures

FIG. 2
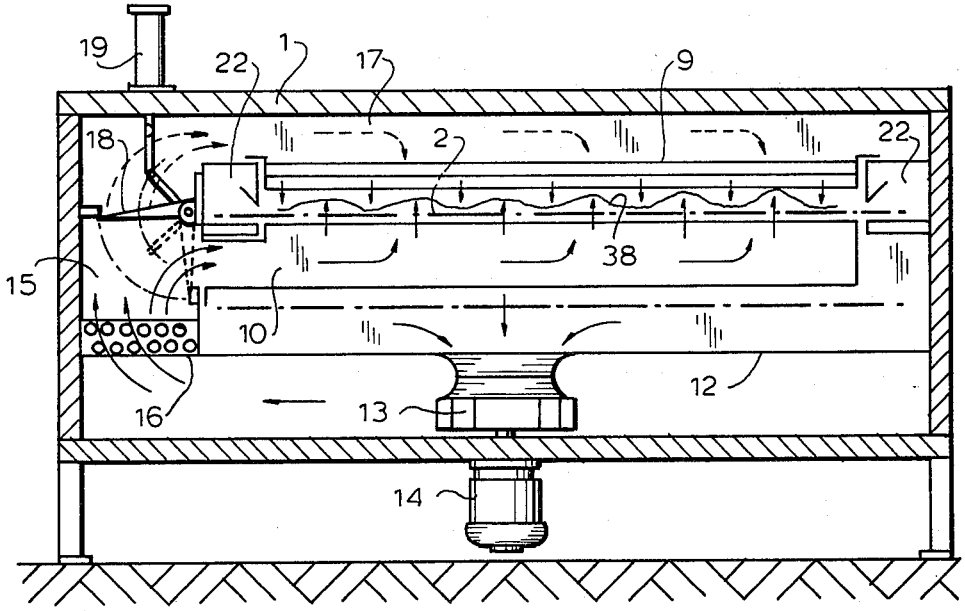
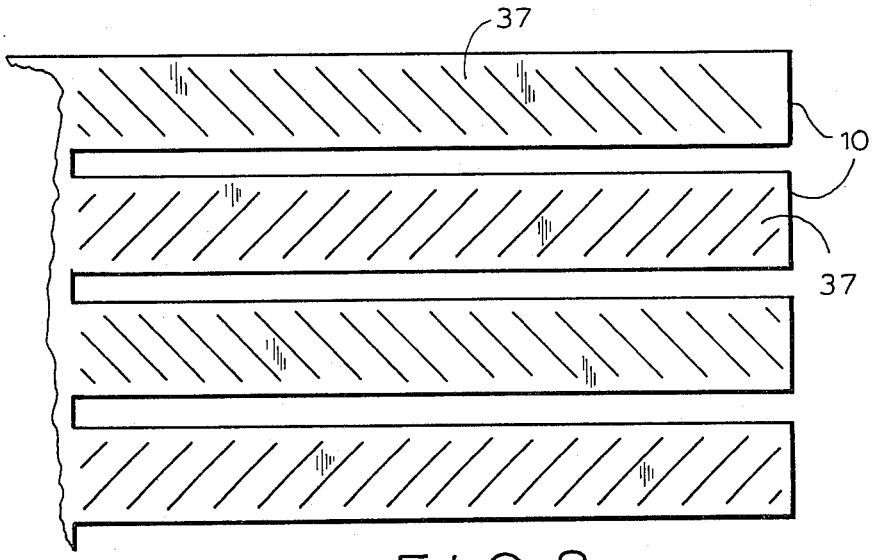
FIG. 8

FIG. 3
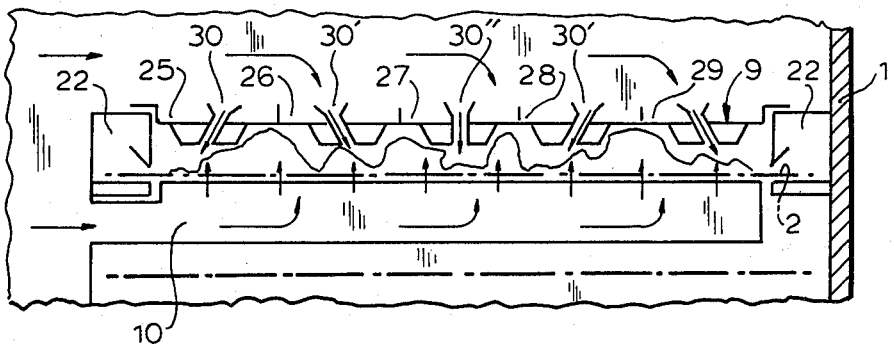
FIG. 4
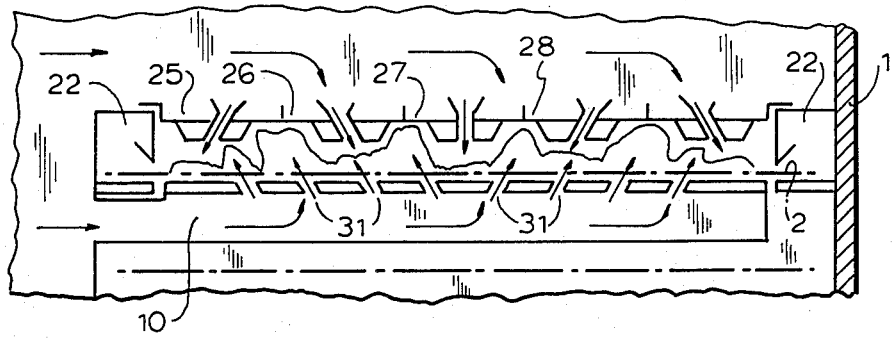
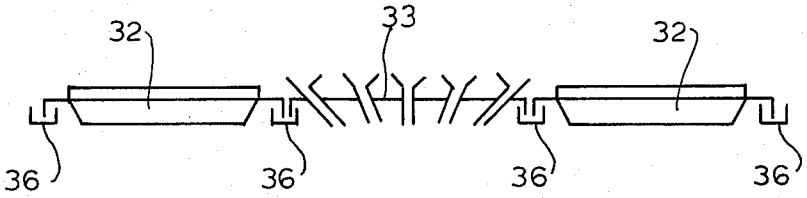
FIG. 7

FIG.5
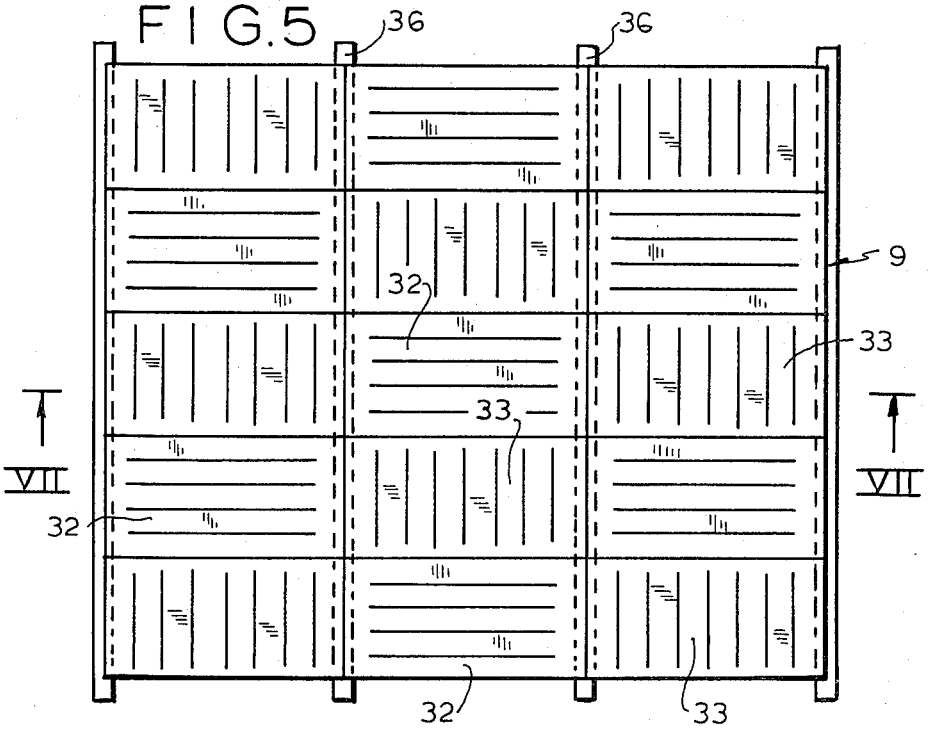
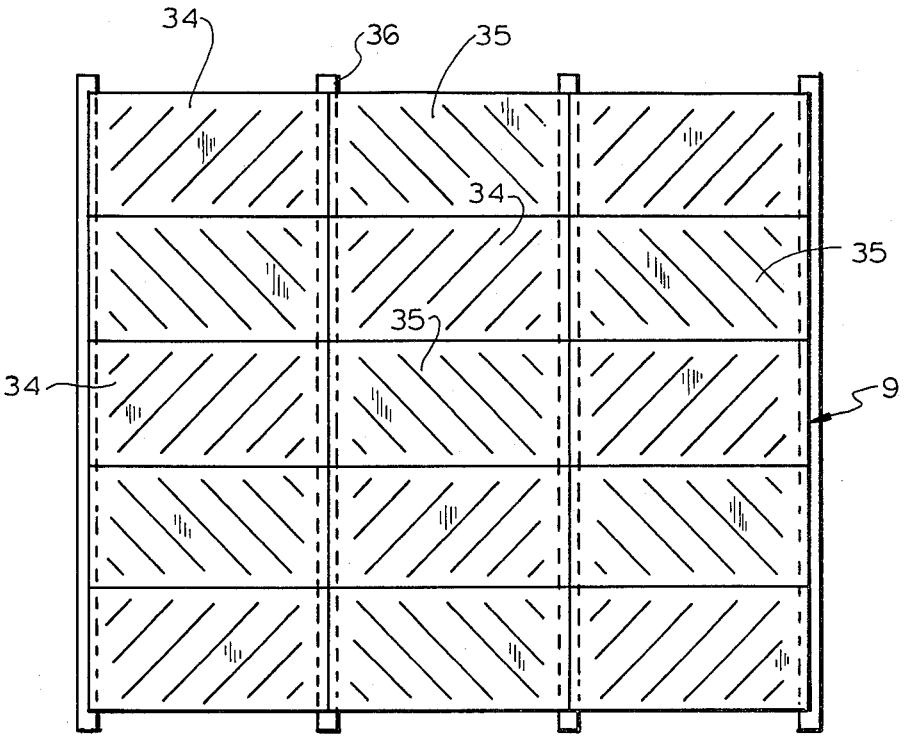
FIG.6

APPARATUS FOR HEAT TREATING A CONTINUOUSLY MOVING WEB

FIELD OF THE INVENTION

The present invention relates to an apparatus for heat treating a continuously moving web. More particularly this invention concerns such an apparatus for fulling or drying a textile web.

BACKGROUND OF THE INVENTION

A heat-treatment apparatus is known, for example from my German published patent application No. 2,810,178, wherein a textile web is loaded onto the upstream end of an upper stretch of a gas-pervious conveyor belt that passes through a heat-treatment chamber. Upwardly directed lower nozzles below the belt and downwardly directed upper nozzles above the belt are alternately fed hot air under pressure to heat treat the web and simultaneously move it on the belt. To allow the web to move, it is fed loosely onto the belt by being deposited thereon at a speed substantially greater than the belt-advance speed. Such treatment not only dries the web, but also normally improves its hand and preshrinks it.

The upper nozzles are formed by a multiplicity of small evenly spaced perforations in an upper wall and the lower nozzles are elongated transverse to the path and are formed by slots in distribution and support boxes underneath the belt. As a result there is an extremely even and gentle flow of air, so that the web is treated quite gently. Although this gentle treatment is normally considered a plus of the system, especially when applied to natural fibers, it has been found that it imparts shine to many synthetics. In particular synthetic textiles with a pile extending warpwise of the goods are frequently rendered quite shiny. As a result blankets or the like made of such pile have a fake look that makes them unable to compete with blankets made of natural fibers.

OBJECTS OF THE INVENTION

It is therefore an object of the present invention to provide an improved heat-treatment apparatus for a longitudinally moving textile web.

Another object is the provision of such an apparatus which does not smooth and shine the web being treated like the above-discussed apparatus.

SUMMARY OF THE INVENTION

These objects are attained according to the instant invention in an apparatus of the above-described general type which comprises as is well known a gas-pervious conveyor belt having a stretch defining a treatment path having an upstream end and a downstream end, means for feeding the web to the upstream end and for advancing the belt to advance the web toward said downstream end along the path, a plurality of upwardly directed lower slot nozzles underneath the stretch along said path, a plurality of downwardly directed upper slot nozzles above the stretch along the path and means for feeding a hot gas alternately to the upper and lower nozzles. According to the instant invention the lower slot nozzles are transverse to at least some of the upper slot nozzles.

The instant invention has been found to produce a far better treated product than the prior-art systems. The stretching and displacement of the web is in two rather than one dimension, so that the web is not polished. In addition knit goods are found to be substantially better preshrunk with this system which in general relaxes any filament stress inside the goods. As a result the finished product normally is satisfactorily limp, with no tendency to curl at the edges or ends, unlike the product of the prior-art machine which was only stretched longitudinally or warp-wise.

According to another feature of this invention the lower nozzles are generally perpendicular to the path. The principal job of the hot air or other treatment gas issuing upwardly from these lower nozzles is to lift the goods off the belt. Normally a plurality of distribution boxes support the belt stretch and are each formed with two such lower nozzles. Each such pair of nozzles therefore creates an air cushion.

It is also possible according to further features of the invention for some of the upper nozzles to extend generally parallel to the path and the balance of the upper nozzles to extend transverse to the path.

The apparatus of the instant invention has, according to yet another feature of the present invention, an upper wall spaced above the belt stretch and formed of a plurality of panels formed in turn with the upper nozzles. The upper nozzles of some of the panels are oriented differently from the upper nozzles of the balance of the panels. This effect is best exploited when, according to the invention, the panels are removably supported in the upper wall and are formed with throughgoing slots constituting the respective upper nozzles. Thus it is possible by switching around these panels to tailor the effect to the particular job at hand. This is seen in an arrangement wherein the upper nozzles are directed at an angle to perpendiculars drawn from the belt stretch.

It is also possible within the scope of this invention for the upper nozzles to include inner nozzles over the center of the path and outer nozzles over the edges of the path. The outer nozzles are directed outwardly to spread the web out weft-wise.

The upper wall in the apparatus according to this invention includes struts extending above and transverse to the path. The panels have edges supported on these struts. The upper wall further can have struts extending parallel to the path and interconnecting the transverse struts.

In order to maximize the weft-wise stretching effect the lower nozzles extend at an acute angle to the path. This is achieved according to the instant invention when the apparatus has as is known distribution boxes connected to the alternate blowing means, extending transverse to the path underneath the stretch, and formed with the lower nozzles. Thus the standard construction style of these machines is employed with modification for the system according to the instant invention.

DESCRIPTION OF THE DRAWING

The above and other features and advantages will become more readily apparent from the following, reference being made to the accompanying drawing in which:

FIGS. 2 and 3 are sections respectively along lines II—II and III—III of FIG. 1;

FIG. 4 is a view similar to FIG. 2 showing another arrangement according to the invention;

FIGS. 5 and 6 are bottom views of upper nozzle arrays according to this invention;

FIG. 7 is a section taken along line VII—VII of FIG. 5; and

FIG. 8 is a top view of lower nozzle array according to this invention.

SPECIFIC DESCRIPTION

Figure 1:
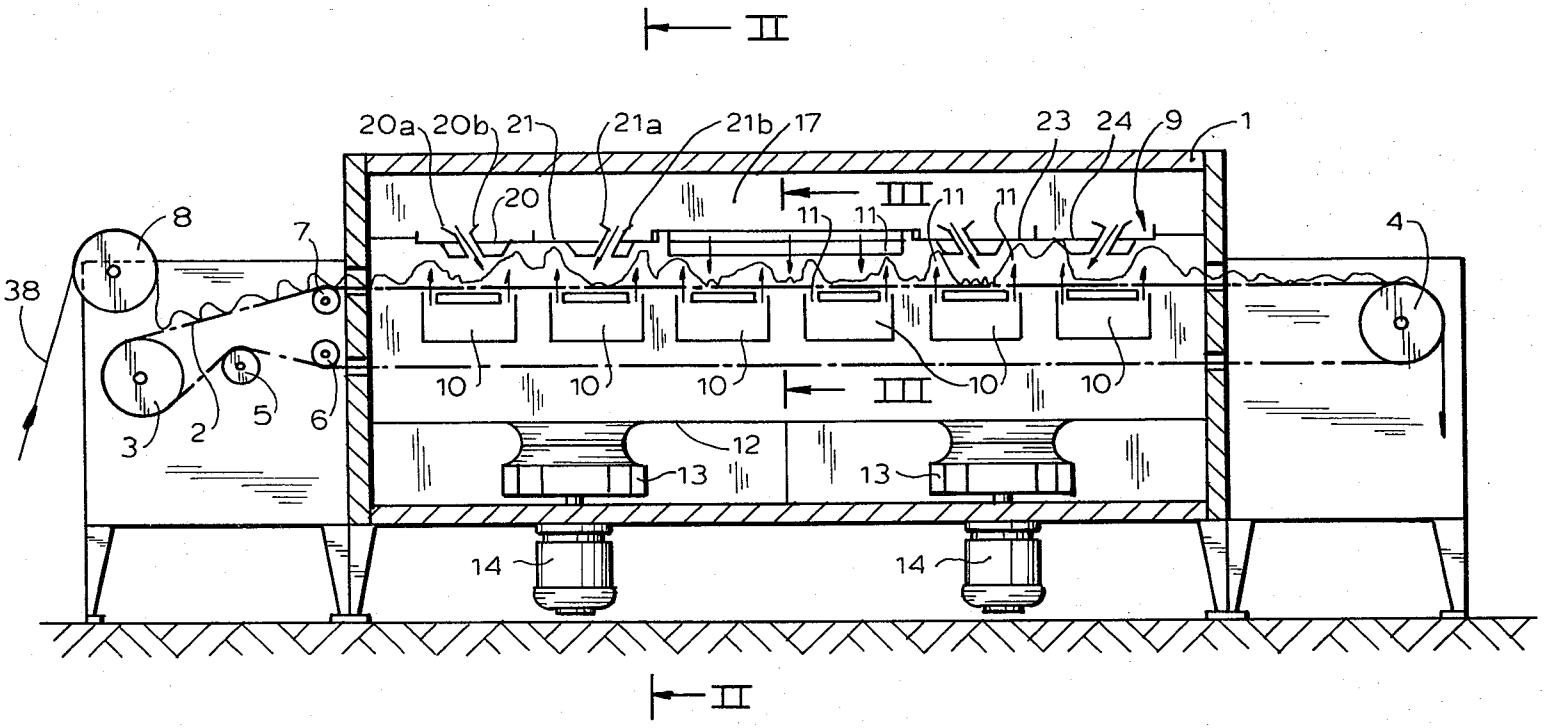
FIG. 1 is a partly schematic longitudinal section through the apparatus according to the instant invention.

As seen in FIGS. 1–3 a heat-treatment apparatus has a housing 1 through which passes a conveyor belt 2 spanned over an idling upstream roller 3 and a driven downstream roller 4. Deflecting and tensioning rollers 5, 6, and 7 are also engaged by the belt. The upper stretch of the belt, which upper stretch is referred to hereinafter simply as the "belt," defines a horizontal treatment path along which a textile web 38 to be treated is moved from left to right as seen in FIG. 1. A feed roller 8 deposits the web 38 at the upstream end of the belt 2 outside the housing 1 at a speed equal to at least 1.5 times, and preferably 2.5 to 4.0 times, the advance rate of the belt 2.

Inside the housing 1 the belt 2 passes under an upper wall 9 and over a plurality of distribution boxes 10 extending perpendicular to the path and supporting the belt 2. Each of these boxes 10 is formed at its usptream and downstream edges with vertically open slots 11. The boxes 10 are spaced apart in the transport direction by spacings equal to about half of their lengths in this direction. Underneath the boxes 10 the housing 1 has a lower wall 12 through which open the axial inlets of axial-input/radial-output blowers 13 having motors 14 wholly outside the housing 1.

FIG. 2 shows how the housing 2 is formed to one side of the belt 2 with a vertical passage 15 opening at its lower end under the lower wall 12, at its upper end into a chamber 17 above the upper wall 9, and in its middle into the interiors of the boxes 10. A heat exchanger is provided at the lower end of this passage 15 so that air blown out by the blowers 13 will be heated before it passes up the passage 15. A flap 18 can block the upper end of the passage 15 where it opens above the upper wall 9 or the side where it opens into the boxes 10. A standard pneumatic cylinder 19 is connected to this flap 18 as in the above-described earlier German patent to alternately block and unblock these outlets from the passage 15, alternating once every 0.25 sec–1.0 sec.

The upper wall 9 is formed principally by a plurality of plates or panels 20, 21, 23, and 24 extending perpendicular to the belt and supported at their outer ends on rails 22 extending parallel to, above, and to the side of the belt 2. The transversely extending edges of these panels are bent to stiffen them. The panels 20 and 21 are further provided with extra plates 20*a*, 20*b* and 21*a*, 21*b* that define respective downwardly open nozzles, the former inclined back in the transport direction through the apparatus and the latter inclined forwardly into this transport direction. The plates 23 and 24 are similarly constructed. These slots therefore extend perpendicular to the belt 2.

Between the plates 20 and 21 on one side and the plates 23 and 24 on the other there are provided as best seen in FIG. 4 plates 25, 26, 27, 28, and 29 whose longitudinal ends are supported on the plates 21 and 23 while the edges of the outer plates 25 and 29 are supported on the rails 22. These plates form downwardly opening outer nozzles 30, inner nozzles 30′, and a single central nozzle 30″, all extending parallel to the belt 2. The outer nozzles 30 are directed outwardly, the inner nozzles 30′ inwardly, and the central nozzle 30″ straight down. Such a combination of differently directed nozzles virtually works and kneads the web 38 as it is being dried.

FIG. 4 shows how the system may be provided with longitudinally extending lower nozzles 31 instead of the nozzles 11. These nozzles 31 are directed outwardly from the center out as well as upwardly to increase the kneading effect described above.

In FIGS. 5 and 7 an arrangement is shown wherein longitudinal and transverse struts 36 of U-section receive bend-down edges of panels 32 whose slots extend parallel to the belt 2 and panels 33 whose slots are perpendicular thereto. The panels 32 and 33 alternate, checkerboard-fashion, for most effective working of the web 38.

The arrangement of FIG. 6 is substantially identical to that of FIG. 5, except that the panels 34 and 35 have opposite but diagonal slots. In fact the panels 34 and 35 may be identical, just differently oriented on the support struts 36.

Finally FIG. 8 shows an arrangement wherein the boxes 10 are formed with alternately oppositely inclined diagonal slots 37. Such an array of nozzles simply buffets the web 38 about to prevent it from becoming polished and shiny.

The system of the instant invention has been found to be extremely effective in eliminating stresses inside a fabric, as well as in effectively preshrinking fabric. The web can be treated with considerable speed due to the strong mechanical action. Nonetheless since only air currents are used to move the web, the action is not rough enough to damage even relatively fragile goods.

We claim:

1. An apparatus for heat-treating an elongated textile web, comprising:
   - a gas-pervious conveyor belt having a stretch defining a treatment path having an upstream end and a downstream end;
   - means for feeding the web to said upstream end and for advancing said belt to advance said web toward said downstream end along said path;
   - a plurality of upwardly directed lower slot nozzles underneath said stretch along said path, said lower nozzles being generally perpendicular to said path;
   - a plurality of downwardly directed upper slot nozzles above said stretch along said path, said lower slot nozzles being transverse to at least some of said upper slot nozzles;
   - means for feeding a hot gas alternately to said upper and lower nozzles; and
   - a plurality of distribution boxes supporting said stretch and each formed with two such lower nozzles, some of said upper nozzles extending generally parallel to said path and the balance of said upper nozzles extending transverse to said path.

2. The apparatus defined in claim 1, further comprising an upper wall spaced above said stretch and formed of a plurality of panels formed in turn with said upper nozzles, the upper nozzles of some of said panels being oriented in the directions different from that of the upper nozzles of the balance of said panels.

3. The apparatus defined in claim 2 wherein said upper nozzles are directed at an angle to a perpendicular drawn from said stretch.

4. The apparatus defined in claim 2 wherein said panels are removably supported in said upper wall and are formed with throughgoing slots constituting the respective upper nozzles.

5. The apparatus defined in claim 4 wherein said upper wall includes struts extending above and transverse to said path, said panels having edges supported on said struts.

6. The apparatus defined in claim 5 wherein said upper wall further comprises struts extending parallel to said path and interconnecting the transverse struts.

7. The apparatus defined in claim 1, wherein said distribution boxes are connected to said means for feeding a hot gas and extended transverse to said path underneath said stretch, and formed with said lower nozzles.

8. An apparatus for heat-treating an elongated textile web, said apparatus comprising:

a gas-pervious conveyor belt having a stretch defining a treatment path having an upstream end and a downstream end;

means for feeding the web to said upstream end and for advancing said belt to advance said web toward said downstream end along said path;

a plurality of upwardly directed lower slot nozzles underneath said stretch along said path, said lower nozzles being generally perpendicular to said path;

a plurality of downwardly directed upper slot nozzles above said stretch along said path, said lower slot nozzles being transverse to at least some of said upper slot nozzles;

means for feeding a hot gas alternately to said upper and lower nozzles; and an upper housing wall spaced above said stretch and formed of a plurality of panels formed in turn with said upper nozzles, the upper nozzles of some of said panels being oriented differently from the upper nozzles of the balance of said panels, said upper nozzles being directed at an angle to a perpendicular drawn from said stretch and including inner nozzles over the center of said path and outer nozzles over the edges of said path, said outer nozzles being directed outwardly.

* * * * *